US009470458B1

(12) United States Patent
Martin et al.

(10) Patent No.: US 9,470,458 B1
(45) Date of Patent: Oct. 18, 2016

(54) MAGNETIC METHOD FOR STIMULATING TRANSPORT IN FLUIDS

(75) Inventors: James E. Martin, Tijeras, NM (US); Kyle J. Solis, NE Rio Rancho, NM (US)

(73) Assignee: Sandia Corporation, Albuquerque, NM (US)

( * ) Notice: Subject to any disclaimer, the term of this patent is extended or adjusted under 35 U.S.C. 154(b) by 1592 days.

(21) Appl. No.: 12/893,104

(22) Filed: Sep. 29, 2010

Related U.S. Application Data

(60) Provisional application No. 61/256,366, filed on Oct. 30, 2009.

(51) Int. Cl.
*F28D 15/00* (2006.01)
*F28F 13/12* (2006.01)
*F28D 1/047* (2006.01)

(52) U.S. Cl.
CPC ..... *F28D 1/0472* (2013.01); *F28F 2250/00* (2013.01); *F28F 2250/08* (2013.01)

(58) Field of Classification Search
CPC ..... F28F 2250/00; F28F 2250/08
USPC ..... 165/109.1, 903, 104.23; 523/300
See application file for complete search history.

(56) References Cited

U.S. PATENT DOCUMENTS 3,713,211 A * 1/1973 Freeman, Jr. ..... 29/599
5,505,880 A * 4/1996 Kormann et al. ..... 252/62.54
6,844,378 B1 * 1/2005 Martin et al. ..... 523/300
2004/0234379 A1 * 11/2004 Miner et al. ..... 417/50
2007/0155024 A1 * 7/2007 Miethe et al. ..... 436/524
2007/0158882 A1 * 7/2007 Dardik et al. ..... 266/104
2008/0277275 A1 * 11/2008 Kubo ..... 204/403.01
2008/0279698 A1 * 11/2008 Bau ..... 417/50
2009/0013867 A1 * 1/2009 McCutchen ..... 95/35
2009/0041993 A1 * 2/2009 Faris ..... 428/207
2009/0055108 A1 * 2/2009 Molokov et al. ..... 702/57
2009/0118817 A1 * 5/2009 Sandhu et al. ..... 623/1.39
2011/0150669 A1 * 6/2011 Frayne et al. ..... 417/53

OTHER PUBLICATIONS

Jonathan G. Fairman, "Weight and Balance Forces Action on an Airplane", Aug. 1996, National Aeronautics and Space Administration.*

H. Arbell and J. Fineberg, Spatial and Temporal Dynamics of Two Interacting Modes in Parametrically Driven Surface Waves, vol. 81, No. 20, Nov. 16, 1998, pp. 4384-4387.

Jin Young Kim, et al, Sythesis and Real-Time Magnetic Manipulation of a Biaxial Superparamagnetic Colloid, 2005 American Chemical Society, publ. on Web May 15, 2005, pp. 11151-111511.

Hyun-Jae Pi, et al, Superiattice, Rhombus, Square, and Hexagonal Standing Waves in Magnetically Driven Ferrofluid Surface, 2000 The American Physical Society, pp. 5316-5319.

Azusa Ujihara, et al, Average Heat Transfer Rates measured . . . , International Journal of Heat and Mass Transfer 49 (2006), pp. 3555-3560.

Kyle J. Solis and James E. Martin, Isothermal Magnetic Advection: Creating functional fluid flows for heat and mass transfer, Applied Physics Letters 97, 2010, pp. 1-3.

* cited by examiner

*Primary Examiner* — Allen Flanigan
*Assistant Examiner* — Jason Thompson
(74) *Attorney, Agent, or Firm* — Kevin W. Bieg

(57) ABSTRACT

A method for producing mass and heat transport in fluids, wherein the method does not rely on conventional convection, that is, it does not require gravity, a thermal gradient, or a magnetic field gradient. This method gives rise to a unique class of vigorous, field-controllable flow patterns termed advection lattices. The advection lattices can be used to transport heat and/or mass in any desired direction using only magnetic fields.

20 Claims, 4 Drawing Sheets

MAGNETIC METHOD FOR STIMULATING TRANSPORT IN FLUIDS

This patent application claims priority benefit from U.S. provisional patent application Ser. No. 61/256,366, filed on Oct. 30, 2009, which is incorporated herein by reference.

The United States Government has rights in this invention pursuant to Department of Energy Contract No. DE-AC04-94AL85000 with Sandia Corporation.

BACKGROUND OF THE INVENTION

This invention relates to transport in fluids. Thermal transport by convection was first visualized in 1900 by Henri Bénard in an experiment wherein a thin layer of liquid with a free top surface was heated from below. This experiment produced a hexagonal pattern of flow cells that Bénard attributed to the buoyancy of the fluid near the hot surface. In 1916 Rayleigh obtained a theoretical understanding of the experimental conditions that give rise to "Rayleigh-Bénard" convection—at least for the case where the liquid surfaces are bounded by contacting plates—and predicted convective rolls, circles, and linear and square patterns. Experimental and theoretical work in the ensuing century elucidated many such complex and beautiful convection patterns, such as convection lattices. In 1970, it was discovered that applying a magnetic field gradient along the thermal gradient could enhance natural convection in magnetic fluids[6]. The enhancement is dependent upon the thermal gradient and does not lead to new flow patterns.

BRIEF DESCRIPTION OF THE DRAWINGS

The accompanying drawings, which are incorporated in and form part of the specification, illustrate some embodiments of the present invention and, together with the description, serve to explain the principles of the invention.

DETAILED DESCRIPTION OF THE INVENTION

Figure 1A:
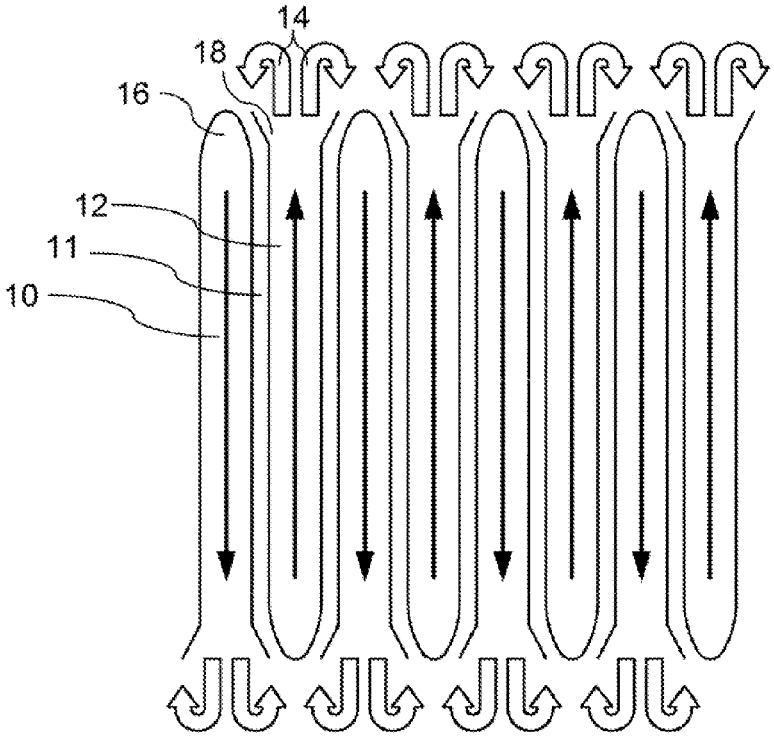
FIG. 1 illustrates schematically an advection lattice produced with an octave biaxial field whose two components have a relative phase angle of 45°. This lattice is illustrated schematically (1*a*) in cross-section as viewed along the plane of the biaxial field and (1*b*) in cross-section as viewed perpendicular to the field plane.

This invention comprises a method for producing heat and mass transport in fluids, wherein the method does not rely on conventional convection mechanisms, that is, it does not require gravity, a thermal gradient, or a magnetic field gradient. This method gives rise to a unique class of vigorous, field-controllable flow patterns termed advection lattices. The advection lattices can be used to transport fluid in any desired direction using only magnetic fields. The strength of the magnetic fields can be very modest; an example is the magnetic fields produced by moderately sized Helmholtz coils. Embodiments of the present invention include the stimulation of helical flows, the spontaneous formation of free-standing fluid structures, and the creation of chaotic advection under particular field conditions.

Embodiments of this invention comprise magnetic particles in a fluid forming magnet-field-controllable flow patterns termed advection lattices. These advection lattices are distinguished from conventional convection lattices where a thermal gradient is required to change material density to allow a gravity-controlled process for causing movement of a fluid. These advection lattices are also distinguished from thermomagnetic convection where a thermal gradient is required to change the magnetic susceptibility of the fluid to allow a magnetic-field gradient to cause movement of the fluid.

While the direction of transport by natural convection is determined by gravitational effects due to thermally-induced density gradients, advective transport in embodiments of this invention can be produced in any direction as determined by the dynamic magnetic field that is established by crossed magnetic fields.

In embodiments of this invention, time-dependent biaxial magnetic fields are employed. In some embodiments, isothermal magnetic advection can be induced using a time-dependent field and an orthogonal dc field. The embodiments described below employed substantially orthogonal time-dependent fields, but some embodiments can employ fields that are not fully orthogonal. A wide range of magnetic field strengths, frequencies, phases, and waveforms may be used in various embodiments of this invention.

In embodiments of this invention, magnetic particles move in patterns largely determined by the details of the applied biaxial field, as will be discussed below. The magnetic particles can be made of a wide variety of materials. For example, the particles can comprise one or more magnetic metals. The particles can comprise nonmetallic magnetic materials. Ferromagnetic materials and ferrimagnetic materials can be employed. The particles can be composite particles comprising a magnetic material as part of the composite. Some types of composite particles suitable for use in embodiments of this invention include but are not restricted to coated particles where the coating is a magnetic material and the interior of the particle is nonmagnetic and coated particles where the coating is nonmagnetic and the interior of the particles is a magnetic material. Composite particles where both an interior region and a coating are magnetic materials may also be employed.

Figure 3:
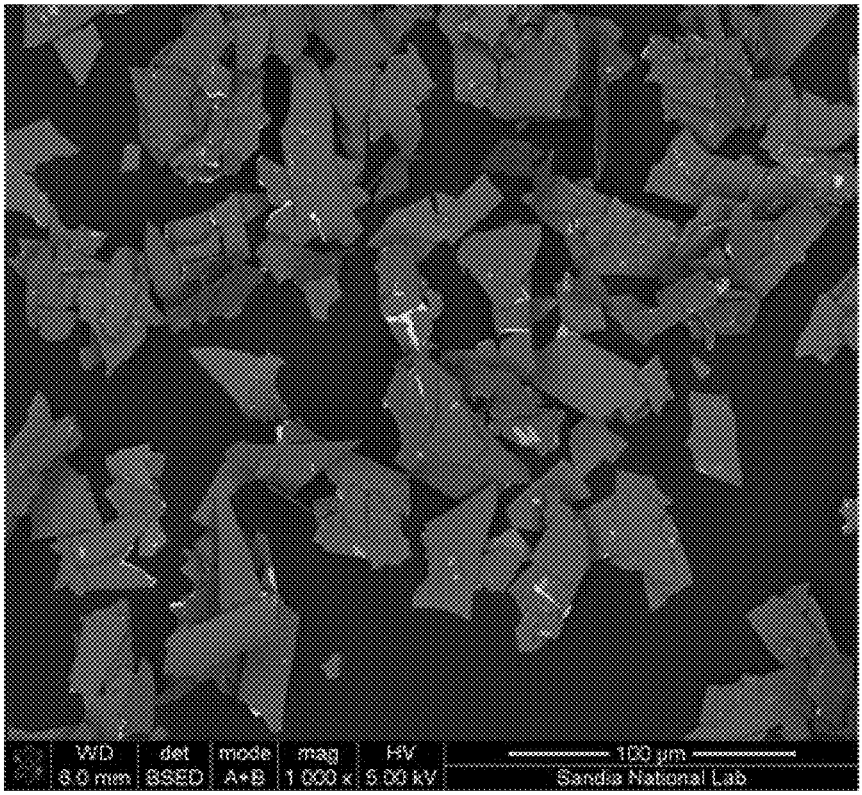
FIG. 3 is a scanning electron micrograph (SEM) image showing magnetic platelets.

The shape of the magnetic particles is an important characteristic. Substantially spherically symmetric particles do not readily undergo efficient advective transport. Oblate spheroidal particles and lower-symmetry particles sharing some characteristics of oblate spheroids can interact with the biaxial field such that they effect advective transport. Examples include platelets and flakes. A high degree of symmetry is not a requirement for the particles. In general, the particles should be thinner in one direction and wider in the other two directions, providing a generally platelet-like structure whose surface can be of a wide variety of geometric shapes. For example, in one embodiment, approximately 20-micrometer platelets comprising a nickel core and a magnesium fluoride coating have been employed. FIG. 3 is an SEM image of multilayer magnetic platelets comprising a 50 nm Ni core sandwiched between 92 nm $MgF_2$ coatings. The platelets possess a highly irregularly shaped morphology with an average size of about 20 μm across and about 234 nm thick. Statements and descriptions made herein in terms of ellipsoids may be understood to apply to more irregularly shaped bodies.

There are several factors operative in isothermal magnetic advection. A uniform magnetic field applied to an isothermal fluid doesn't exert a force on a particle, but it can exert torque on anisometric particles, such as platelets or rods. The emergent dynamics of the process operative in embodiments of the invention are associated with platelet fluttering in the time-dependent fields. In a static field, a magnetically soft platelet will orient such that the local field vector (the sum of the applied field and the fields produced by the other particles) lies in the platelet plane—a so-called demagnetizing field effect that minimizes its magnetostatic energy. A magnetically soft material does not retain its magnetization in the absence of an applied magnetic field. Both magnetically soft materials and magnetic materials that are not soft may be used in embodiments of this invention. The orientation of the platelets will be strongly coupled by their mutual magnetic interactions, yet each platelet will still be free to rotate around this local field vector, so a soft orientational degree of freedom remains, analogous to that operative in a weathervane. In a time-dependent field the platelets will continuously reorient in an attempt to minimize their magnetostatic energy. These field-driven motions will couple hydrodynamically to produce to the complex emergent behavior characteristic of isothermal magnetic advection.

The effects related to isothermal magnetic advection are not to be simply understood in terms of a force on a single particle suspended in a liquid. Rather, they are an emergent behavior of an ensemble. This distinguishes isothermal magnetic advection in a fundamental way from thermomagnetic convection, which can be explained in terms of the temperature dependence of the Kelvin force (the force on a magnetic object in a field gradient) on an individual particle. This Kelvin force increases with decreasing temperature, due to the negative pyromagnetic coefficient of ferrofluids, so if the magnetic field gradient is applied along the thermal gradient, the body force is larger on the cooler fluid, which adds to the buoyancy that drives natural convection.

A uniform magnetic field in an isothermal fluid doesn't exert a force on a particle, but it can exert torque on anisometric particles, such as platelets or rods. The emergent dynamics of the process of embodiments of this invention is associated with platelet fluttering in the time-dependent fields. In a static field, a magnetically soft platelet orients so that the local field vector (sum of applied field and fields produced by other particles) lies in the platelet plane, a demagnetizing field effect to minimize magnetostatic energy. The orientation of the platelets will be strongly coupled by their magnetic interactions, yet each platelet will still be free to rotate around this local field'vector, so a soft orientational degree of freedom remains. In a time-dependent field the platelets will continuously reorient in an attempt to minimize their magnetostatic energy. These field-driven motions will couple hydrodynamically to produce to the complex emergent behavior observed in embodiments of this invention. Discussions presented herein related to ellipsoids may be understood to apply to more irregularly shaped bodies.

The particles and surrounding fluid move in response to the applied time-dependent biaxial magnetic field. The field-controllable flow patterns are termed advection lattices. Advective transport can be in any direction as determined by the orientation of the plane of the dynamic biaxial field vector established by the crossed magnetic fields. The formation of these advection lattices occurs in some embodiments when a suspension of magnetic platelets is subjected to time-dependent, biaxial magnetic fields. These biaxial fields consist of two substantially orthogonal components. In some embodiments, alternative field orientations are employed, and one field can be dc instead of time-varying. The flow structure is sensitive to the phase relation of the field components. For embodiments employing sinusoidal waveforms with frequencies related by just intervals, i.e., having frequency ratios that are ratios of small integers (octaves, perfect fourths and fifths, major thirds, etc.), a variety of flow patterns can be produced; the structure is quite sensitive to the phase relation of the field components. In such embodiments, the advection lattices generally consist of a checkerboard of anti-parallel flow columns that are normal to the plane of the biaxial field. With approximately 20 micron platelets, vigorous flow patterns are produced with frequencies in the low audio range (10-1000 Hz) and with each component having a root-mean-square (rms) amplitude in excess of 75 G. Non-just intervals can also be used and result in a magnetic field that changes phase constantly at a rate dependent on the values of the field components (i.e., the field is "beating"). This phase modulation causes the fluid to transition through a variety of different flow patterns and structures, which may have utility for particular applications.

In some embodiments, an additional field that is orthogonal to the biaxial fields may be applied. The application of a dc field normal to the biaxial field plane has different effects depending on the dc field magnitude. For large dc field amplitudes (for example, greater than approximately 25% of the biaxial field component amplitudes), chaotic advection ensues, resulting in strong mixing of the platelet suspension. At lower dc field amplitudes (for example, approximately 12% of the biaxial field component amplitudes), the symmetry of the flow column diameters is broken. The relative diameters of all columns flowing in one direction become about half the diameter of the columns flowing in the other direction. The third field component may be time-dependent, as the other two. In this case, the pattern fibrillates or "shimmers". In different embodiments, different frequency relationships between the three field components can be used to produce different advection lattices or flow fields.

Figure 1B:
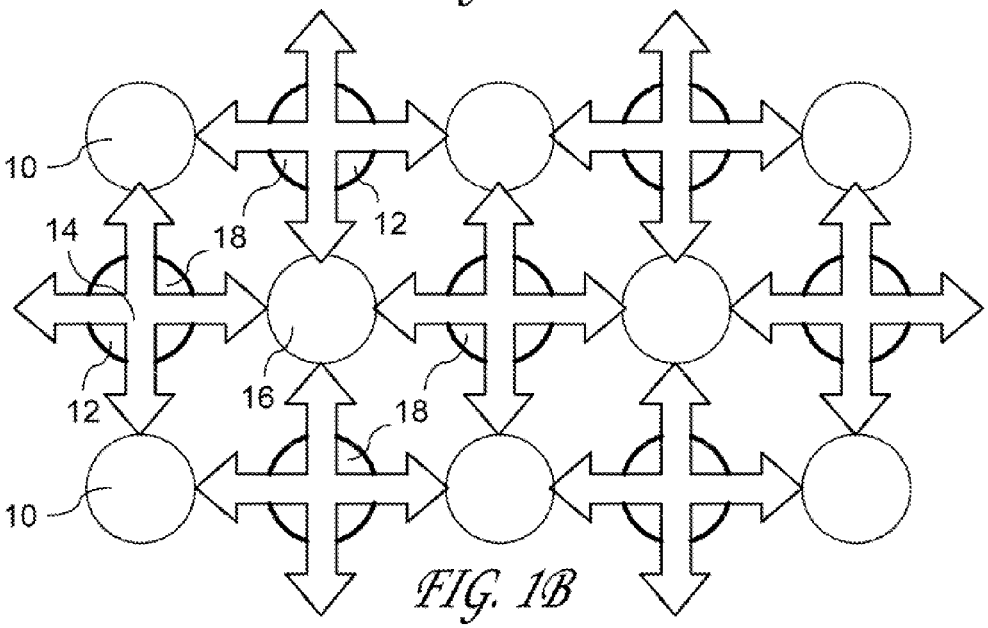
Figure 2A:
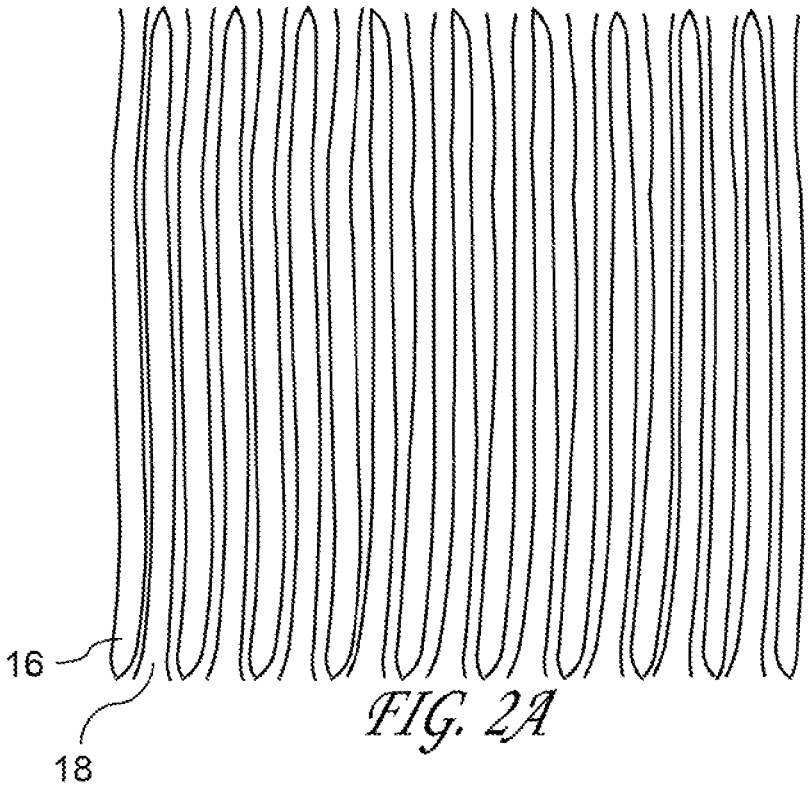
FIG. 2 illustrates the effect of phase on advection lattices produced using a component frequency ratio of 150 Hz:75 Hz at (2*a*) 45° phase shift and (2*b*) 0° phase shift.

One simple flow pattern occurs with an octave biaxial field whose two components have a relative phase angle of 45°. This is illustrated schematically in cross-section and plan view in FIG. 1. In FIG. 1*a*, the view is in the plane of the biaxial field showing one row of fluid columns where adjacent columns 10 and 12 flow in opposite directions in the presence of the biaxial field. As illustrated schematically in the plan view of FIG. 1*b*, this flow pattern comprises a "checkerboard"-type pattern of fluid columns wherein the fluid in adjacent columns is flowing in opposite directions. As the fluid in upward-flowing columns 12 approaches the boundary where it will turn, the fluid flows outward, as illustrated by arrows 14, as it reverses direction and forms the downward-flowing columns 10. In some embodiments, this phase angle is defined as that added to the high-frequency component if each field component is expressed as a sine function. The field frequencies were 75 and 150 Hz, and the rms field amplitudes were 150 G. Applying this field to the platelet suspension immediately stimulates the striking flow pattern illustrated schematically in FIG. 2*a*, which consists of 1.3 mm diameter flow columns that span the 3 cm cell. Each column has a sharp tip 16 corresponding to where the flows from the tails 18 of four adjacent columns are combining to form the central column. The tails 18 appear more diffuse. The direction of flow within a column is from tip to tail, as indicated by arrows in FIG. 1*a*. Tracer particle studies show that the flow rate is about 3 $cm \cdot s^{-1}$, and that adjacent columns flow in opposite directions. A tracer particle in the regions 11 between columns will rapidly spin either clockwise or counterclockwise, due to the high shear rate in these regions. The countercurrent flow columns pack onto a rectangular lattice, so the advection lattice can be described as a checkerboard of columns, as illustrated in FIG. 1*b*. This symmetric flow pattern does not occur in Rayleigh-Bénard convection, presumably because gravity breaks up-down symmetry.

Figure 4:
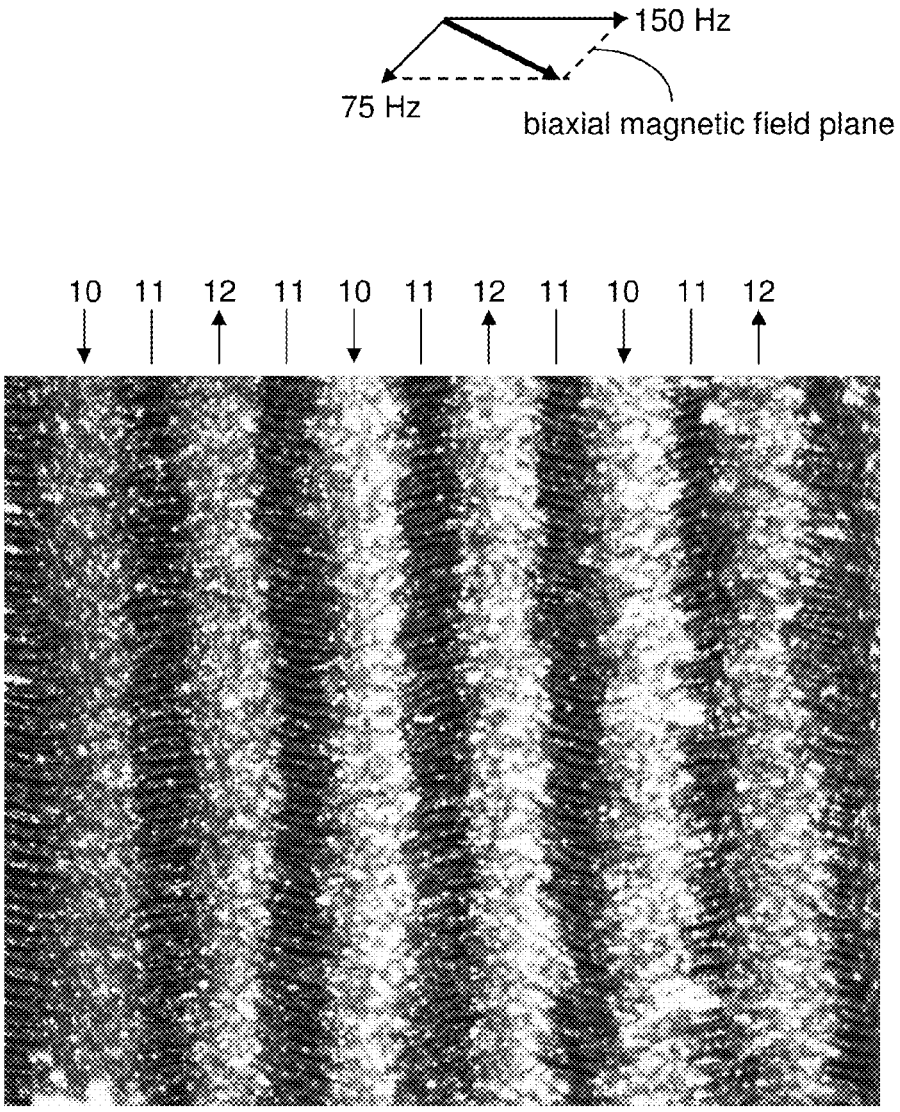
FIG. 4 is an optical image of an advection lattice formed by a spatially uniform biaxial magnetic field.

FIG. 4 is an image of an advection lattice formed by the spatially uniform biaxial magnetic field. As described above, the octave biaxial field has two components with frequencies of 150 and 75 Hz and a relative phase angle of 45°. The time-varying field vector comprising the two components will make a bowed figure eight Lissajous pattern in the plane of the biaxial magnetic field. The advection lattice comprises antiparallel flow columns 10 and 12 flowing approximately normal to the plane of the biaxial magnetic field that can transport heat and mass between the upper and lower boundaries. The platelets can be seen edge-on as nearly horizontal, dark lines in the regions 11 between the flowing columns.

These advection lattices will effectively transport heat if the column diameter is not too small compared to the gap between hot and cold surfaces. Experiments over one decade in field frequency between 100 and 1000 Hz show an inverse dependence of column diameter on frequency, which enables optimization of thermal transport for a fluid volume of a given size. This frequency range was limited by the hardware being employed in this embodiment. A different range of frequencies can be employed in embodiments when the hardware is capable of operating at the different frequencies.

Figure 2B:
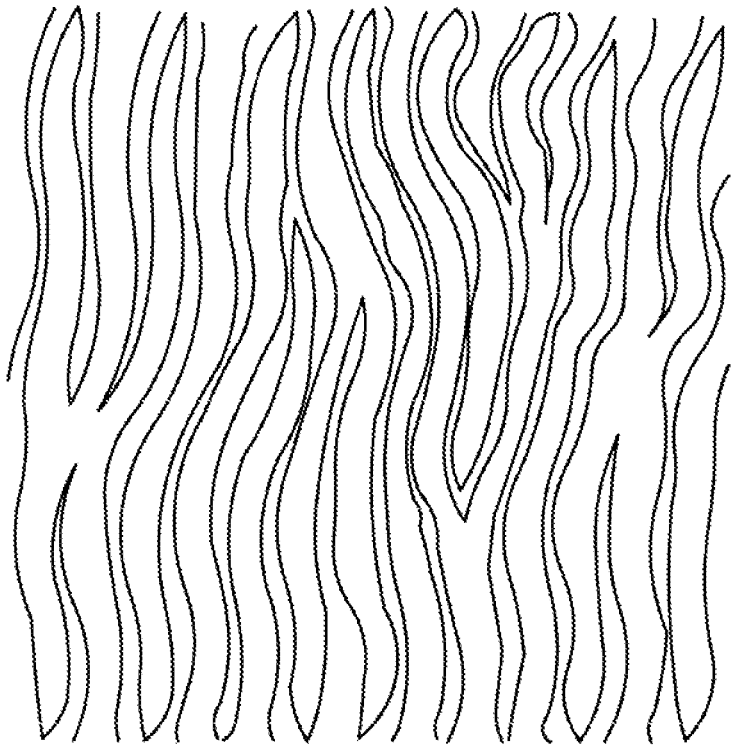

The dependence of flow pattern on the phase between field components has been demonstrated in some embodiments. For one example, one can phase-modulate an octave interval (frequency ratio of 2:1) by increasing the frequency of the high-frequency component by 0.1 Hz. This phase modulation produces a sequence of complex flow patterns that repeat every 10 seconds. At a phase angle of 0°, the columns are wavy and writing and tend to form pairs. They also can exhibit bifurcation points at the free surface of the liquid, as shown schematically in FIG. 2*b*. This pattern results from spontaneous chiral symmetry breaking, with alternate columns having opposite directions of helical flow. Near a phase angle of 45°, the writhing columns become straight and stationary, as shown schematically in FIG. 2*a*. At a phase angle of roughly 90°, the columns become less prominent and have approximately half the diameter of the columns produced at a phase angle of 45°. The transition between phases produces a variety of patterns that may appear to form gradually from alteration of a pattern or they may appear to form abruptly and vanish quickly rather than displaying an evolving relationship with the pattern at a different phase.

In embodiments using a biaxial field having a 3:1 frequency ratio (a musical twelfth), one obtains helical flow (helical flow is typically characterized by streamlines in the shape of coil springs, similar to the stripes on a candy cane) within the columns, but in this case the vortex component is in the same sense for all columns, producing a body torque. These helical flows reach a maximum intensity at phase angles of 90° and 270° and are equal and opposite in sign, as determined by measuring the body torque with a torsion balance. The flow vorticity also produces a rapid migration of the columns normal to their flow direction, which causes the fluid to pile up on one or the other side of the cell, depending on the phase. This effect does not constitute chiral symmetry breaking, as the sign of the torque is deterministic. The torque on a platelet that has an induced magnetic moment is due to the rotation of the magnetic field, $H \times \dot{H}$. This quantity varies periodically and averages to zero for biaxial fields comprised of sinusoidal components of differing frequencies.

If a dc field component is applied approximately normal to the biaxial field, the advection can become chaotic. This chaotic advection produces extremely strong fluid mixing and can be a useful way to stir the magnetic platelets into the solution, should they have settled. This effect can be used for mixing in microfluidic devices or for mixing applications on larger dimensional scales.

At higher particle concentrations, one can observe surface instabilities in the form of stationary ripples that run parallel to the intersection of the field plane with the fluid surface. If one starts with a dry powder of platelets, the dropwise addition of solvent causes the progressive emergence of a free-standing fluid ridge supported only by the vigorous flow pattern contained within. In the case of the 3:1 biaxial field this ridge sloshes side-to-side due to the helical flow within the columns. The behavior in various embodiments can be altered by alteration of the particle shape and particle thickness.

In various embodiments, the fluid phase of the suspension can be selected from a wide variety of liquids. As isothermal magnetic advection depends on the hydrodynamic coupling between the particles, a low viscosity solvent serves to reduce viscous drag and results in a better resolved advection lattice. For heat transfer applications, fluid properties such as heat capacity and thermal conductivity can be useful design parameters; water or water/ethylene glycol mixtures generally have good heat capacity and thermal conductivity. More viscous fluids can be used in some applications.

A wide range of frequencies can be employed. The details of the advective transport are partly determined by the relationship between the two magnetic fields that make up the biaxial field. Some magnetic field characteristics that can be varied in different embodiments of the invention are discussed here. One characteristic is the relationship of the frequencies of the two magnetic fields. One type of frequency relationship that can be used is the just interval relationship. A just interval is one in which the frequencies are related by a ratio of whole numbers. In general practice, just intervals may have frequencies that are ratios of small integers. Some examples include but are not restricted to octaves, perfect fourths and perfect fifths, and major thirds. Another way of expressing this is that the frequencies are members of the same harmonic series. For component frequencies that form a just interval, the flow pattern is dependent on the phase relationships between the components. In various embodiments, the pattern may or may not be stable.

Other non-just frequency intervals may also be employed in embodiments of this invention.

Sinusoidal waveforms can be used, but waveforms that are not simple sinusoidal waveforms can also be used in different embodiments. Examples of other suitable waveforms include but are not restricted to square waves and sawtooth waves.

The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

The invention claimed is:

1. A method for transporting mass or heat, the method comprising:

providing a suspension of a plurality of anisometric magnetic particles in a fluid;

applying a time-varying biaxial magnetic field to the suspension, wherein the time-varying biaxial magnetic field comprises two components, each having an axis, wherein at least one of the components is a time-dependent field having a frequency and wherein the axes of the two components are not co-linear, and forming in response to the time-varying biaxial magnetic field an advection lattice comprising the anisometric magnetic particles for the transport of mass or heat by the fluid.

2. The method of claim 1, wherein the axes of the two components of the time-varying biaxial magnetic field are substantially orthogonal.

3. The method of claim 1, wherein one component is a dc component.

4. The method of claim 1, wherein the frequency of at least one of the components is between approximately 10 Hz and approximately 1000 Hz.

5. The method of claim 1, wherein an amplitude of the time-varying biaxial magnetic field exceeds approximately 50 Gauss rms for each component.

6. The method of claim 1, wherein the two components are time-dependent fields, each having a frequency, and wherein the waveforms of the two components are sinusoidal with frequencies related as a ratio of integers.

7. The method of claim 6, wherein the frequencies are related by just intervals.

8. The method of claim 1, wherein the two components are time-dependent fields, each having a frequency, and wherein the method further comprises forming a time-varying advection lattice by using a non-just frequency interval relationship of the frequencies of the two components.

9. The method of claim 1, wherein the two components are time-dependent fields, each having a frequency, and wherein waveforms of the two components are selected from the group consisting of sinusoidal waveforms, square waveforms, and sawtooth waveforms.

10. The method of claim 1, wherein the two components are time-dependent fields, each having a frequency, and wherein the method further comprises applying a third magnetic field approximately normal to a plane of the time-varying biaxial magnetic field.

11. The method of claim 10, wherein the third magnetic field is a dc field.

12. The method of claim 11, further comprising inducing mixing in the fluid through chaotic advection.

13. The method of claim 10, wherein the third magnetic field is a time-dependent field.

14. The method of claim 1, wherein the two components are time-dependent fields, each having a frequency, and wherein the frequencies of the two components retain a fixed phase relationship.

15. The method of claim 1, wherein the two components are time-dependent fields, each having a frequency, and wherein the frequencies of the two components are phase-modulated.

16. The method of claim 1, wherein the advection lattice comprises an array of anti-parallel flow columns that are approximately normal to a plane of the time-varying biaxial magnetic field.

17. The method of claim 1, wherein the advection lattice comprises an array of columns with helical flow.

18. The method of claim 1, wherein the anisometric magnetic particles comprise a platelet-like structure.

19. The method of claim 1, wherein the anisometric magnetic particles are selected from the group consisting of nonmetallic magnetic particles and metallic magnetic particles.

20. The method of claim 1, wherein the anisometric magnetic particles are coated particles selected from the group consisting of particles with a magnetic interior and a nonmagnetic exterior coating, particles with a nonmagnetic interior and a magnetic exterior coating, and particles with a magnetic interior and a magnetic exterior coating.

* * * * *